US006113198A

United States Patent [19]

Hommes

[11] Patent Number: 6,113,198

[45] Date of Patent: Sep. 5, 2000

[54] COLLECTIBLES DISPLAY CABINET WITH INTERIOR ELECTRICAL OUTLETS

[75] Inventor: Jack L. Hommes, Zeeland, Mich.

[73] Assignee: Howard Miller Clock Company, Zeeland, Mich.

[21] Appl. No.: 09/154,436

[22] Filed: Sep. 16, 1998

[51] Int. Cl.[7] ..... A47F 3/00

[52] U.S. Cl. ..... 312/114; 312/223.6; 211/26

[58] Field of Search ..... 312/223.6, 128, 312/265.4, 7.2, 111, 280, 127; 248/239; 211/26; 108/50.02

[56] References Cited

U.S. PATENT DOCUMENTS

| | | | |
|---|---|---|---|
| 4,489,995 | 12/1984 | Barr | 312/223.6 |
| 4,856,746 | 8/1989 | Wrobel et al. | 248/239 |
| 5,022,720 | 6/1991 | Fevig et al. | 312/223.5 |
| 5,794,794 | 8/1998 | Hull | 211/26 |

OTHER PUBLICATIONS

Collectibles Displays, Inc. Brochure (undated).

*Primary Examiner*—Janet M. Wilkens
*Assistant Examiner*—Jerry A. Anderson
*Attorney, Agent, or Firm*—Warner Norcross & Judd LLP

[57] ABSTRACT

A cabinet having height-adjustable shelves and power receptacles in the interior of the cabinet. A power cord is attached to and runs essentially the height of the cabinet. In-line power receptacles are releasably attached to and in electrical communication with the power cord, enabling each receptacle to be positioned adjacent each shelf. The height-adjustable shelves are supported by T-shaped shelf clips removeably installed in bore holes in the cabinet.

14 Claims, 3 Drawing Sheets

COLLECTIBLES DISPLAY CABINET WITH INTERIOR ELECTRICAL OUTLETS

BACKGROUND OF THE INVENTION

The present invention relates to cabinets for the display of collectibles, and more particularly such cabinets having interior electrical power receptacles.

Collectibles include miniaturized models of village buildings, houses, and cottages. These collectibles incorporate ornate detail and may include interior lights for enhanced visual effect. Each such lighted collectible requires a power connection—typically a power cord extending from the rear of the collectable and designed to be plugged into a common household power receptacle.

Collectors often store and display the collectibles in display cabinets, which typically include glass walls and shelves to permit viewing of the collectibles without opening the cabinet. Collectors may arrange the collectibles on the shelves to replicate village settings. Such settings may include cotton to simulate snow and cover the power cords. The shelves of a display cabinet are typically designed to be height-adjustable to a variety of desired shelf heights.

Designers of lighted-collectibles display cabinets are thus faced with the challenge of providing an electrical power source to the interior of the cabinet in order to power each lighted collectible. Further, the electrical power source must be adjustable to accommodate the varying shelf-height locations. Cabinet designers also seek to minimize the visual distraction that interior power systems may cause, thereby disrupting the "village" effect of the combined display of the collectibles.

One such prior art cabinet is sold by Collectible Displays Inc. of West Chester, Ohio. This cabinet is illustrated in the brochure included with the Information Disclosure Statement filed with this application and also is illustrated in FIG. 1 of this application. The prior art collectibles cabinet 10 includes shelf 12 designed to support and display lighted collectibles (not shown). Shelf 12 is adjustable in height. A power compartment 14 mounted under shelf 12 includes compartment base 15 and hinge door 17. The shelf includes one or more openings to permit power cords from the collectibles to be inserted into the power compartment. An electrical-receptacle power strip 16 is mounted to hinge door 17. Power cords 19 from lighted collectibles are plugged into receptacle power strip 16. Hinge door 17 can be closed to hide power receptacle 16 and power cords 19.

However, collectibles display cabinet 10 has several disadvantages. The fold-away compartment 14 adds to the manufacturing complexity, shelf weight, and cost of the collectibles display cabinet 10. The shelf cannot be fabricated of glass as is desirable in collectibles cabinets. Further, the fold-away compartment 14 reduces the space available between shelves for storage and display of collectibles.

An existing system for supporting height-adjustable shelves rests the shelves on L-shaped shelf clips 23. (FIG. 6.) Each shelf clip has an insert post 35 and shelf support portion 36. The insert post 35 of shelf clip 23 is inserted into a bore hole formed in the cabinet. The shelf rests on the shelf support portion 36.

Because shelf track 22 is made of wood, over time the diameter of bore hole 34 in shelf track 22 may expand or enlarge because of wood shrinkage in a dry climate—or may deform because of the stress of supporting the shelf together with the objects displayed on the shelf. As a result of the gradually deformed bore holes, the shelf clips gradually support the shelf lower relative to the original height. If the bore holes deform sufficiently, the shelf is so low that the L-shaped shelf clips slip out of their bore holes. This causes the shelf to fall and destroy the collectibles that may be displayed on the shelf.

SUMMARY OF THE INVENTION

The aforementioned problems are overcome in the present invention wherein a cabinet case includes height-adjustable electrical power outlets within the interior of the cabinet. More specifically, a power cord extends the height of the interior of the cabinet. One or more moveable power receptacles are attached to the power cord, preferably each adjacent to one of the shelves, to provide an electrical power outlet for selected shelves.

The display cabinet of the present invention has several advantages. First, the shelves can be made of glass or any other material. Second, a minimal number of in-line power receptacles can be precisely located to minimize the visually displeasing clutter of interior power cords. Further, if a collector changes a shelf height, the collector can easily and quickly adjust the height of the associated receptacle by unsnapping it from an existing position and relocating it to the desired height along the power cord. Third, the present invention is simpler and therefore less expensive than prior systems.

In a second aspect of the invention, the shelves are supported by T-shaped shelf clips. Each shelf clip has a post extending from the upper portion of the cross of the "T" and opposite the base of the "T." The post is inserted into a bore hole in the cabinet. The shelf rests on the base of the "T." The lower portion of the cross of the "T" engages the cabinet to minimize the risk that the post will slip from the bore hole if the bore hole deforms or enlarges over time due to the weight of the shelf.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
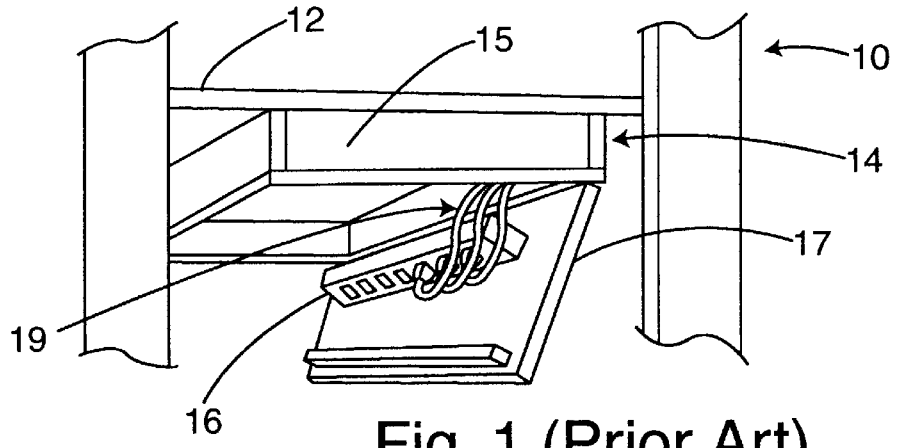
Fig. 1 (Prior Art)
FIG. 1 is a perspective view of a portion of a prior art collectibles display cabinet.
Figure 2:
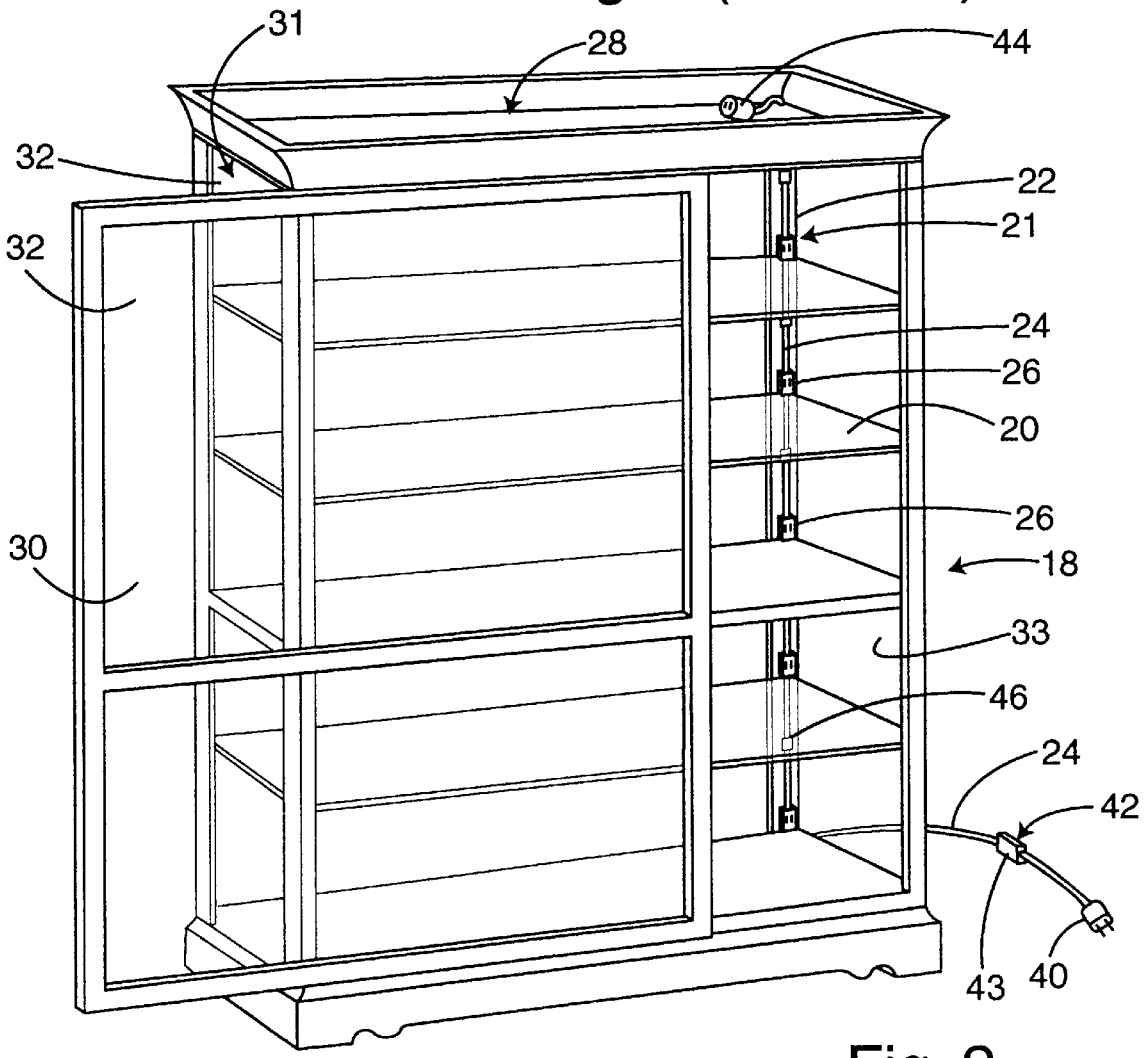
FIG. 2 is a perspective view of the cabinet of the present invention.

The lighted-collectibles display cabinet 18 of the present invention includes shelves 20 adjustably mounted on shelf tracks 22. (FIG. 2.) A power cord 24 runs along the length of the shelf track 22. In-line receptacles 26 are releasably mounted to the power cord 24 to provide power outlets adjacent to each shelf 20. The shelf rests on T-shaped shelf clips 25.

The display cabinet 18 includes cabinet case 28 having walls 31 with interior faces 33. The construction of cabinet cases is well known to those of skill in the art. The cabinet case can be constructed of any suitable material, such as wood, plastic, metal, glass, or combinations thereof. Preferably, the cabinet wall and door portions 32 are made of transparent glass to offer an unobstructed view of the interior of the cabinet case 18. The dimensions of the collectibles display case are suitable for display of collectibles, for example, 80 inches high by 50 inches wide by 21.5 inches deep. The cabinet case can include access door 30, which may be a sliding door in the front of cabinet case 18 to provide an unobstructed view and easy access to the interior of the cabinet. Door 30 can also be a swinging door or other door configuration as is known in the art. The cabinet case may also incorporate: 1) floor levelers (not shown) to help stabilize the cabinet and (2) interior lighting (not shown) to illuminate the cabinet interior.

Figure 3:
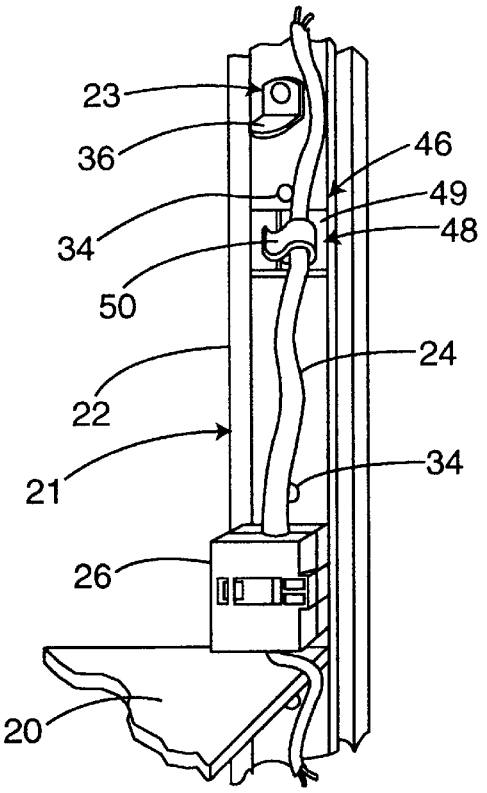
FIG. 3 is a detail view of the shelf track and in-line receptacle.

Display cabinet 18 includes shelf track assembly 21 or other means for adjustability mounting shelves 20 to cabinet case 28. The assembly 21 includes shelf track 22 and shelf clips 23. Shelf track 22 is oriented vertically along the height of the interior face 33 near the interior corners of cabinet case 28. As shown in more detail in FIG. 3, shelf track 22 includes a plurality of evenly spaced circular bore holes 34 centered along the length of shelf track 22. Bore holes 34 can be, for example, 0.25 inches in diameter by 0.5 inches in depth and spaced 1.25 inches apart. Shelf track 22 is made of any material suitable to support structural load, such as, wood, plastic, or metal.

Figure 7:
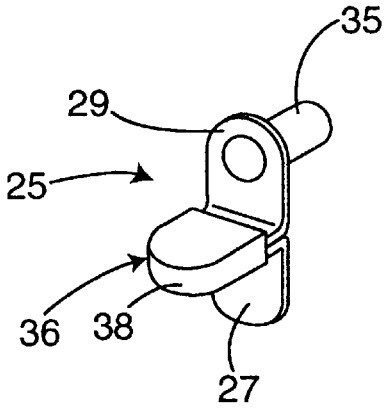
FIG. 7 is a perspective view of the shelf clip of the present invention.
Figure 8:
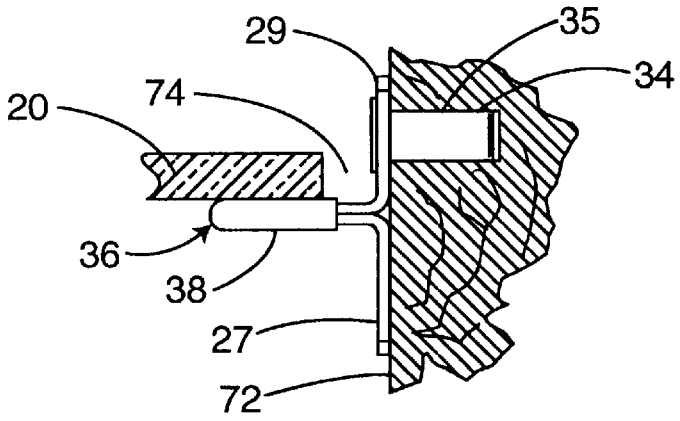
FIG. 8 is a sectional view of the shelf clip of the present invention installed in a bore hole.

The T-shaped shelf clips 25 of shelf adjustable mounting means 21 include shelf support portion 36, safety leg portion 27, and insert post 35 extending from the post support portion 29. (FIGS. 7–8.) Shelf clips 25 can be made of any material suitable to support the shelf load, including wood, plastic, or metal. If the shelf clip is made of malleable material, such as steel, it can be formed from a single piece of material folded or "hemmed-constructed" to form the T-shape, as shown in FIG. 7. The length of safety leg portion 27 depends in part on the amount of tolerance gap 74 between the shelf 20 and cabinet wall, as discussed below. (FIG. 8.) For a T-shaped safety clip having a shelf support portion length of about 22 mm, a post dimension of about 12 mm length by about 6.3 mm diameter—the post located about 8 mm from the centerline of the T-shape—and a tolerance gap 74 of about ⅜ inches, a suitable safety leg portion length is about 18 mm measured from the centerline of the T-shape. Each shelf clip 25 is mounted in a corresponding bore hole 34 of shelf track 22 with the insert post 35 of shelf clip 25 inserted in bore hole 34. (FIG. 8.)

Shelf 20 rests on shelf support portion 36 of shelf clip 25. (FIG. 8.) Typically, the shelf is of a dimension slightly less than the interior of the cabinet so that the shelf can easily be installed in the cabinet. Accordingly, a tolerance gap 74 exists between the cabinet wall and the shelf. Preferably, each corner area of shelf 20 is supported by a shelf clip 25 to provide a level and stable shelf surface. Shelf support portion 36 of shelf clip 25 can be encased in a sleeve 38 (e.g., a plastic or elastomer cap) to cushion the shelf 20 that rests on shelf support portion 36.

Figure 9:
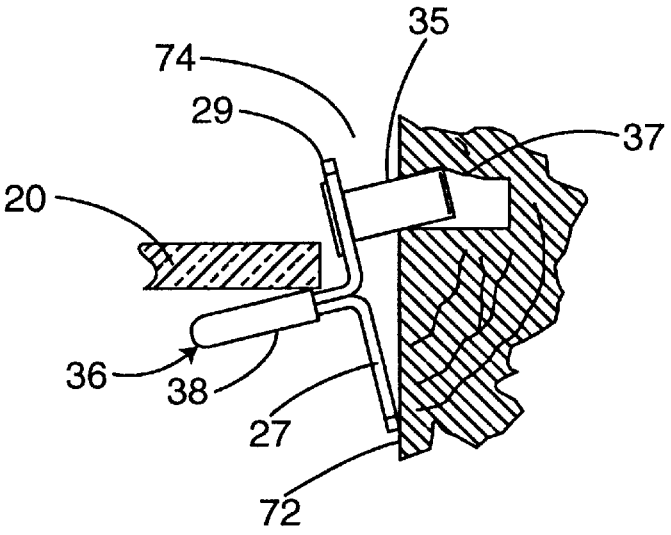
FIG. 9 is a sectional view of the shelf clip of the present invention in an enlarged bore hole.

The T-shaped shelf clips 25 provide added protection against slippage of the shelf clip from the post hole. As shown in FIG. 9, post hole 37 has become either enlarged by wood shrinkage or deformed due to the weight and stress of supporting shelf 20. Accordingly, the shelf weight causes post 35 to slip partially out of the post hole 37 and pivot about the point where the safety clip engages wall 72. In doing so, the pivoting shelf clip also lowers the shelf because the shelf support portion 36 drops.

The slippage and pivoting stop once post support portion 29 crosses the width of tolerance gap 74 to engage shelf 20 in its lowered position. (FIG. 9.) Because the T-shaped safety clip pivots about an extended safety leg portion 27, the pivot radius is increased in comparison to an L-shaped shelf clip. The increased pivot radius reduces the arc through which post support portion 29 must pass before engaging shelf 20. Thus, for a given post-hole enlargement or deformation, the T-shaped safety clip 25 effectively reduces the amount of shelf drop and post slippage in comparison to a corresponding L-shaped shelf clip—and therefore reduces the risk of catastrophic failure. The T-shaped safety clip works effectively when installed with the safety leg portion 27 toward the bottom of the cabinet (FIG. 8) or with the safety leg portion 27 toward the top of the cabinet (not shown).

As an alternative to the track assembly 21, the shelf adjustable mounting means includes other means for adjustably mounting shelves within cabinet cases. For example, the plurality of evenly spaced circular bore holes 34 can be located directly in cabinet case 28, or shelf support brackets can be screwed or nailed or otherwise removably installed either to the shelf track or the cabinet case.

Power cord 24 runs essentially the length of shelf track 22, which in the preferred embodiment is the height of the cabinet. "Running essentially the length" means aligned vertically along the length of the shelf track to be adjacent to each shelf installed in cabinet 18. Power cord 24 is a conventional electric cord and includes outlet plug 40 and switching means 42. Switching means 42 may include a roll switch 43, rotary dimmer, three-stage touch dimmer, foot switch, or other equivalents as are known in the art. Preferably, power cord 24 includes female plug outlet 44 on the end of power cord 24 opposite from the outlet plug 40, in order to provide a convenient power source at the top of the cabinet 18. Power cord 24 exits the bottom of cabinet case 28 so that outlet plug 40 can be inserted into a common wall electrical receptacle (not shown). For U.S. applications, power cord 24 is of a size and design sufficient to supply the 110 volt electricity that is common for U.S. household use. One such power cord is Model T-333-F available from Fumlite, Inc. of Fullston, N.C. Other power cords appropriate for the supply of electricity associated with display cabinets are well known to those of skill in the art.

Wire attachment means 46 aligns and holds power cord 24 along the length of shelf track 22. An example of wire attachment means 46 is wire clip 48, which includes clip base 49 adhesively mounted to shelf track 22 and clip tab 50 extending from clip base 49. Clip tab 50 is biased to hold power cord 24 between clip tab 50 and clip base 49. Other wire attachment means include tape, tacks, and equivalents as are known in the art.

Figure 4:
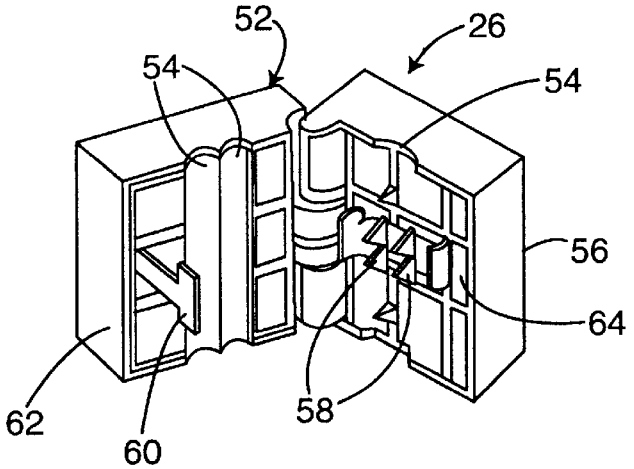
FIG. 4 is a perspective view of the in-line receptacle in the open position.
Figure 5:
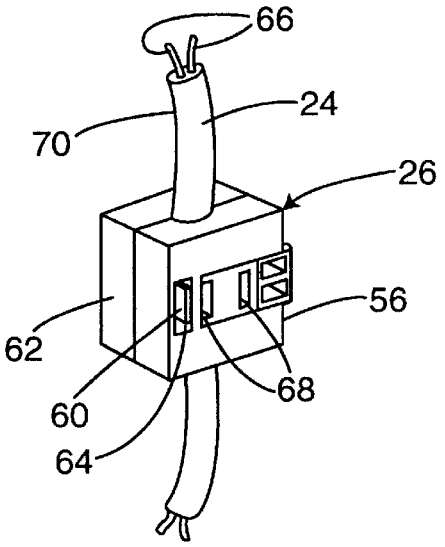
FIG. 5 is a perspective view of the in-line receptacle in the installed, closed position.
Figure 6:
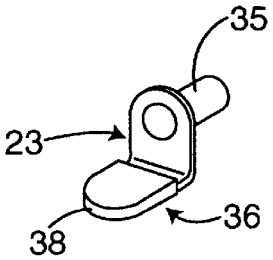
FIG. 6 is a perspective view of the prior art shelf clip.

Adjustable in-line power receptacle 26 is attached to and in electrical communication with power cord 24. In-line receptacles are well known to those skilled in the art and are available, for example, from Eagle Electric Co., as the EAGLE ACADEMY Model No. 2606B. In-line receptacle 26 includes hinged casing 52 forming grooves 54 adapted to receive power cord 24. (FIG. 4.) Top portion 56 includes insulation-piercing terminals 58 on the interior surface of top portion 56. T-shaped closure tab 60 is attached to rear portion 62 of hinged casing 52. Top portion 56 forms closure to tab-port 64 adapted to receive tab 60 and lock top portion 56 and rear portion 62 together when in-line receptacle 26 is in the closed position. (FIG. 5.) In the closed position, insulation-piercing terminals 56 are in electrical contact with wires 66 such that the electricity available in wire 66 can travel through outlet ports 68 when an outlet plug from a lighted collectible (not shown) is installed.

Operation

Shelves 20 and in-line receptacles 26 are height-adjustable in cabinet 18. To adjust the shelf height, a user inserts post 35 of T-shaped shelf clips 25 into bore hole 34 at the desire height. The user can then lay shelf 20 on shelf support portion 36 of shelf clips 25. If the user desires to change the shelf height, it is a simple matter to lift the shelf, withdraw shelf clips 25, and install them in corresponding insert post bore holes 34 at the desired height. In-line receptacle 26 is installed by selecting the desired height along power cord 24, placing power cord 24 in grooves 54 of in-line receptacle 26, and bringing rear portion 62 and top portion 56 together so that insulation-piercing terminals 58 pierce insulation 70 of power cord 24 to make electrical contact with wires 66. Simultaneously, closure tab 60 inserts in closure-tab port 64 to lock the rear and top portions of hinged casing 52 together.

When the cabinet is sold, the receptacles can be either installed or uninstalled. If uninstalled, the user first positions the shelves as desired, and then installs a receptacle immediately above each shelf. Shipping the receptacles uninstalled eliminates the need to remove and reinstall the receptacles and also eliminates the need to cover holes in the cord made by the receptacles during the first installation.

If a new height location is desired for in-line receptacle 56, closure tab 60 can be lifted to unlock top portion 56 from rear portion 62 thereby releasing insulation-piercing terminals 58 from power cord 24 and opening the in-line receptacle. The user can then move in-line receptacle 26 to the new desired height, and reinstall it as described above. The pierced-insulation from the old location can be repaired by wrapping it with electrical tape or other methods known in the art.

To facilitate the installation of in-line receptacle 26, the user can lift clip tab 50 of wire clip 48 to free power cord 24 for removal from between clip tab 50 and clip base 49. This procedure provides additional slack in power cord 24 to allow the in-line receptacle 26 to be installed. After installation, power cord 24 is reinstalled in wire clip 48. Thus, multiple shelves and in-line power receptacles can be installed at essentially at any desired height within cabinet 18.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A cabinet with interior electrical power comprising:

a cabinet case;

at least one shelf;

shelf support means for supporting said shelf at a plurality of selectable positions within said cabinet case;

a power cord within said cabinet case including at least one conductor encapsulated by an insulation, said power cord being readily accessible within said cabinet case; and at least one adjustable in-line power receptacle releasably attached to said power cord, said receptacle including means for piercing said insulation and contacting said conductor as said receptacle is attached to said cord whereby said receptacle can be selectively positioned in a desired relationship to said shelf.

2. The cabinet of claim 1 wherein said shelf support means includes:

at least one shelf track mounted to one of said interior faces of said walls; and a plurality of shelf clips adapted for supporting shelves, said shelf clips being removably attached to said shelf track, wherein said shelf clips are adjustable in height along said shelf track.

3. The cabinet of claim 2 wherein said shelf track includes a plurality of bore holes adapted to receive said shelf clips.

4. The cabinet of claim 2 wherein said power cord is attached to and runs essentially the length of said shelf track.

5. The cabinet of claim 1 wherein said shelf support means includes:

a plurality of bore holes in said interior face of at least one of said walls of said cabinet case; and a plurality of shelf clips adapted for supporting said shelves, each said shelf clip being removably inserted into one of said bore holes, wherein said shelf clips are adjustable in height along said interior face.

6. The cabinet of claim 1 further comprising a plurality of said shelves.

7. The cabinet of claim 1 wherein said shelf support means supporting said shelf includes a plurality of shelf tracks.

8. The cabinet of claim 1 wherein said shelf support means includes a plurality of shelf clips, each said shelf clip comprising:

a member having a cross-section being of a T-shape, wherein a base of said T-shape is a shelf support portion, wherein a left side of said T-shape is a post support portion, and wherein a right side of said T-shape is a safety leg portion; and a post extending from said post support portion opposite from said shelf support portion.

9. A cabinet comprising:

a cabinet case having walls each with an interior face and at least one corner;

means for supporting shelves, said means adjustable in height;

a plurality of shelves each resting on said shelf supporting means;

a power cord including at least one wire and insulation disposed around said wire, said power cord capable of supplying electrical power to the interior of said cabinet case;

means for securing said power cord proximate to said corner; and a plurality of adjustable in-line power receptacles clamped to said power cord, said receptacles each including electrical contact means for piercing said power cord as said receptacle is clamped to said power cord.

10. The cabinet of claim 9 wherein each said shelf clip comprises:

a member having a cross-section being of a T-shape, wherein a base of said T-shape is a shelf support portion, wherein a left side of said T-shape is a post support portion, and wherein a right side of said T-shape is a safety leg portion; and a post extending from said post support portion opposite from said shelf support portion, said post adapted for removeable insertion into said bore hole.

11. An adjustable shelf mount and power receptacle comprising:

a shelf track;

a plurality of shelf clips adapted for supporting shelves, each said shelf clip being removably attached to said shelf track, wherein said shelf clips are adjustable in height along said shelf track;

a power cord including a conductive element and an insulator surrounding said conductive element, said power cord attached to and running essentially the length of said shelf track; and at least one releasable and adjustable in-line power receptacle including a terminal for piercing said insulator to provide electrical communication between said power cord and said power receptacle.

12. The adjustable shelf mount and power receptacle of claim 11 wherein said shelf track includes a plurality of bore holes adapted to receive said shelf clips.

13. The adjustable shelf mount and power receptacle of claim 12 wherein each said shelf clip comprises:

a member having a cross-section being of a T-shape, wherein a base of said T-shape is a shelf support portion, wherein a left side of said T-shape is a post support portion, and wherein a right side of said T-shape is a safety leg portion; and a post extending from said post support portion opposite from said shelf support portion, said post adapted for removeable insertion into said bore hole.

14. The adjustable shelf mount and power receptacle of claim 11 further comprising a plurality of wire clips attached to said shelf track and adapted to align said power cord vertically along said shelf track.

* * * * *